United States Patent [19]

Poulouin

[11] Patent Number: 4,867,594

[45] Date of Patent: Sep. 19, 1989

[54] DEVICE FOR SUPPORTING A BLOCK OF SHEETS

[76] Inventor: Armand Poulouin, Place de la Mairie, Saint-Germain-sur-Ille, 35250 Saint Aubin D'Aubigne, France

[21] Appl. No.: 130,589

[22] Filed: Dec. 8, 1987

[30] Foreign Application Priority Data

Dec. 8, 1986 [FR] France ..... 86 17252
Feb. 26, 1987 [FR] France ..... 87 02749

[51] Int. Cl.[4] ..... B42F 3/00; B42F 13/02; B42D 5/00; B42D 17/00

[52] U.S. Cl. ..... 402/70; 402/19; 281/45; 281/44

[58] Field of Search ..... 402/19, 20, 70; 281/15 B, 15 R, 21 A, 45; 206/611; 229/92.1, 92.3; 40/124.1, 405, 537

[56] References Cited

U.S. PATENT DOCUMENTS

| | | | |
|---|---|---|---|
| 1,110,906 | 9/1914 | Deal | 281/45 |
| 1,187,484 | 6/1916 | Bates | 402/70 |
| 1,827,592 | 10/1931 | Lewis | 402/70 |
| 1,841,903 | 1/1932 | McGonigle | 281/15 B |
| 2,520,461 | 8/1950 | Green | 40/405 |
| 2,526,090 | 10/1950 | Slonnbger et al. | 281/45 |
| 2,602,251 | 7/1952 | Friedman | 281/15 B |
| 3,090,143 | 5/1963 | Arnold | 402/19 |
| 4,313,270 | 2/1982 | Volkert et al. | 40/124.1 |

FOREIGN PATENT DOCUMENTS

| | | | |
|---|---|---|---|
| 927061 | 10/1947 | France | 402/20 |
| 1081233 | 12/1954 | France | 281/15 B |

*Primary Examiner*—Donald R. Schran
*Assistant Examiner*—Paul M. Heyrana, Sr.
*Attorney, Agent, or Firm*—Pollock, Vande Sande & Priddy

[57] ABSTRACT

The device comprises a plate (1) whose top face (10) constitutes a writing surface, said plate being elevated above the support surface (S) on which the device stands by means of an underframe (2). One of the edges of the plate is provided with at least one ring (3) for holding sheets onto the plate, the ring interconnecting the two faces of the plate (1) in such a manner that the sheets can be passed beneath the plate by rotating them through 360° around the ring (3). The device is provided with fastening and retaining means (5) for engaging the sheets ($F_2$) beneath the plate (1) at a certain distance (K) above the support face (S).

14 Claims, 4 Drawing Sheets

DEVICE FOR SUPPORTING A BLOCK OF SHEETS

FIELD OF THE INVENTION

The present invention relates to a device for supporting a block of sheets, and which comprises a plate or board whose top face constitutes a writing surface and is raised above the support surface on which the device stands by means of an underframe.

BACKGROUND OF THE INVENTION

In a device of this nature as described in FR-A 857 269, one of the edges of the board is provided with a pair of sheet-retaining rings, and these rings interconnect the two faces of the board in such a manner as to make it possible to pass the sheets from one of the two sides of the board to the other by rotating them through 360° around the rings. The device is reversible, thus making it possible to write on both faces of the sheets, with each face of the board serving as a writing surface if the device is turned over.

A device of this nature has the advantage of making it possible and convenient to write on both the front face and on the rear face of the sheets. However, it suffers from the drawback that, when the device is placed on a support surface, in particular on a table or a desk, the sheets placed under the board deform under gravity and rest against said support surface. The sheets may thus be soiled if the support surface is not completely clean; conversely, the writing on the sheets may be partially transferred onto the support surface and may soil it, in particular if the ink used for writing has not completely dried. Further, the device is awkward to displace since the sheets underneath the board hang vertically therefrom whenever the device is lifted.

A diary of independent sheets, as described in particular in FR-A-2 450 696, comprises a support plate constituting a writing surface on which a block of sheets is removably retained by a ring i.e., which is incomplete (which is not closed). A compartment is provided beneath the support plate for archiving purposes, i.e., for storing sheets which have already been used. This is thus a block of detachable sheets of the calender type which generally has 52 sheets with the days and working hours of each week in the year marked on a front face for noting appointments. Such a device suffers from drawbacks. Firstly, it is difficult to look for sheets which have already been used, since the detached sheets are loose. Secondly, if the support is compact, additional notes concerning the current week are written on the back of the sheet for the preceding week, and this is a source of error when looking through sheets that have been archived. Thirdly, it is difficult to write such notes, since to do so a sheet must be taken out from the compartment and placed on the writing surface.

SUMMARY OF THE INVENTION

The invention seeks to solve these various problems by providing a device which uses non-detachable sheets that can be archived conveniently beneath the support plate in such a manner as to make it easy to search through the sheets corresponding to past weeks as well as the sheets corresponding to future weeks, and without the sheets archived beneath the plate resting against the support surface on which the device stands. Another aim of the invention is to make it possible to write additional notes concerning the current week on the sheet for that week, and to make it easy to obtain access to the useful portion of the notes. A further aim of the invention is to provide a support of minimum bulk, while still providing easily accessible storage.

To do this, the device of the present invention comprises a plate whose top face constitutes a writing surface which is elevated above the support surface on which the device stands by means of an underframe, one of the edges of said plate being provided with at least one ring which passes through cut-outs provided in the edges of the sheets in order to retain the sheets on the plate, said ring interconnecting the two faces of said plate in such a manner as to make it possible to pass the sheets under the plate by rotating them through 360° around the ring, the device further including fastening and retention means for engaging the sheets and suitable for supporting them beneath the plate at a certain distance above said support surface.

In addition, in accordance with a certain number of advantageous characteristics of the invention:

- the ring has an elastically-deformable C-shaped section and is fixed to the edge of the plate by resilient snap-fastening (the ring is received by being elastically deformed);
- the edge of the plate receiving the ring has an inlet chamfer which facilitates ring insertion;
- the bottom portion of the ring is substantially flush with the support surface on which the device stands;
- in a first embodiment, the fastening and retention means are constituted by a pair of side lugs provided with hooks and disposed beneath the plate at a distance apart from each other which is slightly less than the width of the sheets;
- in another embodiment, fastening and retention means are constituted by a shelf extending substantially parallel to the plate and disposed beneath the plate in the vicinity of its edge opposite to the edge receiving the ring, the depth of the shelf being less than the length of the plate; the central portion of the flap is preferably notched;
- the edges of the sheets opposite to the edges through which the ring passes are accessible to the fingers of the user when the sheets are retained beneath the plate;
- a graphics space for receiving notes is provided on that face of each sheet which is visible when the sheet is turned back onto said support surface;
- said graphics space includes at least one network of mutually parallel lines;
- the lines constituting the network are disposed obliquely relative to the edges of the sheets; and
- two crossed networks of oblique lines are provided for use by right-handed and left-handed users, respectively.

BRIEF DESCRIPTION OF THE DRAWINGS

Other characteristics and advantages of the invention appear from the description and the accompanying drawings, which show preferred embodiments of the invention, and in which.

DESCRIPTION OF PREFERRED EMBODIMENTS

Figure 1:
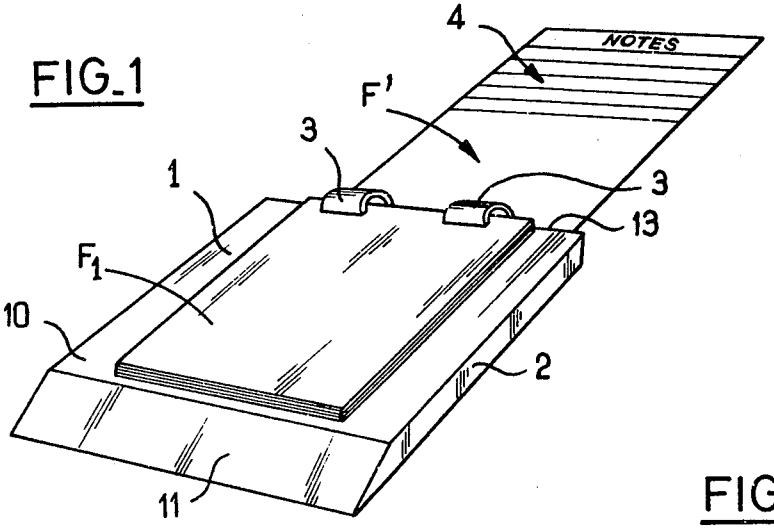
FIG. 1 is a general perspective view of a first embodiment of the device.
Figure 2A:
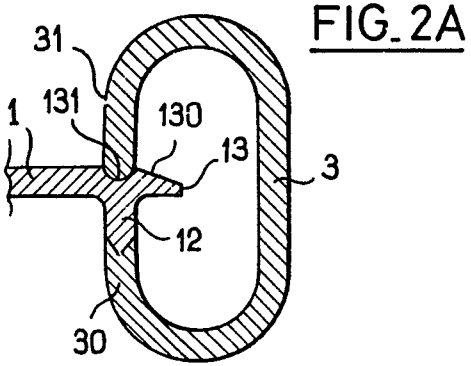
FIG. 2A is a detail view showing how the ring is mounted on the plate that constitutes the writing surface.
Figure 2:
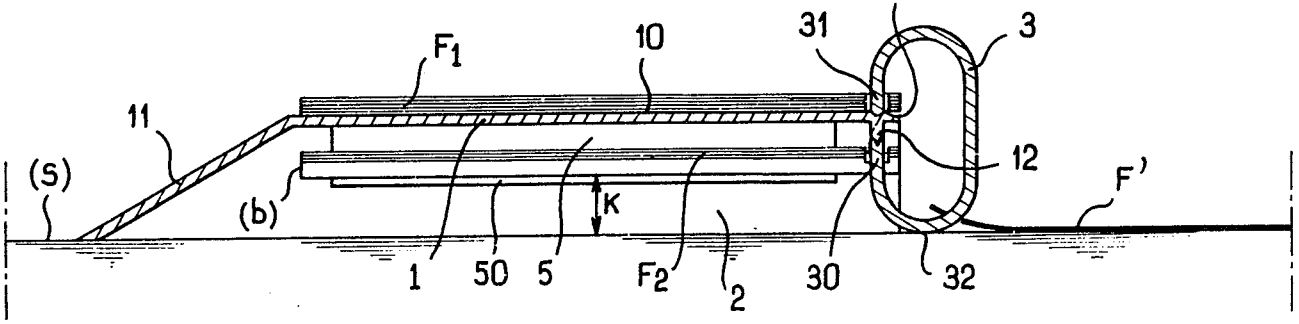
FIG. 2 is a side view of the FIG. 1 device in section and on a larger scale.

The device shown in FIGS. 1 and 2 comprises a plate 1 which is elevated by an underframe 2. The top face 10 of the plate serves as a writing surface and has sheets ($F_1$) placed thereon, which sheets are removably connected to the plate 1 by means of two rings 3. A sheet (F') is shown turned down on the support surface (S) on which the underframe 2 stands, and a graphics space 4 is printed on the rear face of the sheet for receiving additional notes concerning the week mentioned on the front face of the same sheet. The two rings 3 are fixed to one of the edges 13 of the plate by resilient snap-fastening, as can be seen more particularly in FIG. 2A. Each of the rings 3 is generally C-shaped and is made of an elastic, e.g., plastic material. The top edge 31 of the ring 3 is received, for example, in a groove 131 provided on the top of the plate 1, while the bottom edge 30 of the ring has a V-shaped profile which fits over a projection 12 of complementary shape provided on the underside of the plate. The edge 13 has a sloping or chamfered portion 130 which facilitates fitting the ring to the edge of the plate by resilient snap-fastening.

The front edge 11 of the plate 1 opposite to the edge 13 is preferably inclined, thereby facilitating access of the user's hand to the top portion 1 of the plate when writing on the sheets (F).

As can be seen more particularly in FIG. 2, the bottom portions 32 of the rings 3, are substantially flush with the support surface (S) on which the device stands, such that the sheet (F') when folded down onto said surface is quite flat.

In accordance with the invention, fastening and retaining means are provided beneath the plate 1 for engaging sheets ($F_2$) which have been folded under said plate (by rotation through 360°).

Figure 3:
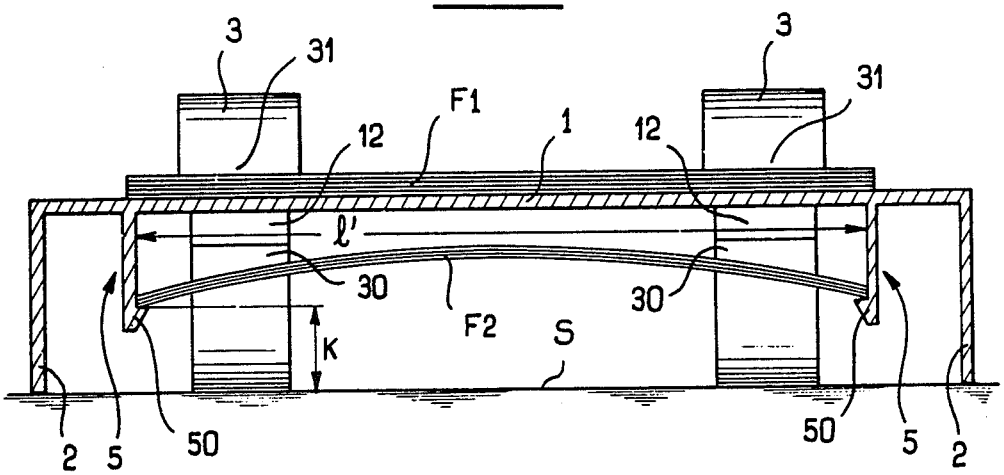
FIG. 3 is an end view, in section, of the FIG. 2 device.

These retaining means, which are clearly visible in FIG. 3, are constituted by a pair of side lugs 5 which are integrally formed with the plate 1 and which are directed perpendicularly downwardly from the plate. The two lugs 5 extend longitudinally parallel to each other beneath the plate 1 and are spaced apart from each other by a distance (1') which is slightly less than the width (1) of the sheets (F) (see FIG. 4).

The bottom edges 5 of the lugs 5 are in the form of retaining hooks and prevent sheets ($F_2$) placed between the two lugs 5 from falling downwards; they are thus suitable for supporting said sheets at a certain distance above the support surface (S) - which distance is designated by reference (K) in FIGS. 2 and 3.

Since the width (1) of the sheets is less than the distance (1') between the lugs, the sheets ($F_2$) take up a slightly curved shape whose convex side is downwardly directed, thereby improving the quality of sheet retention provided by the fastening members 5, 50.

Figure 4:
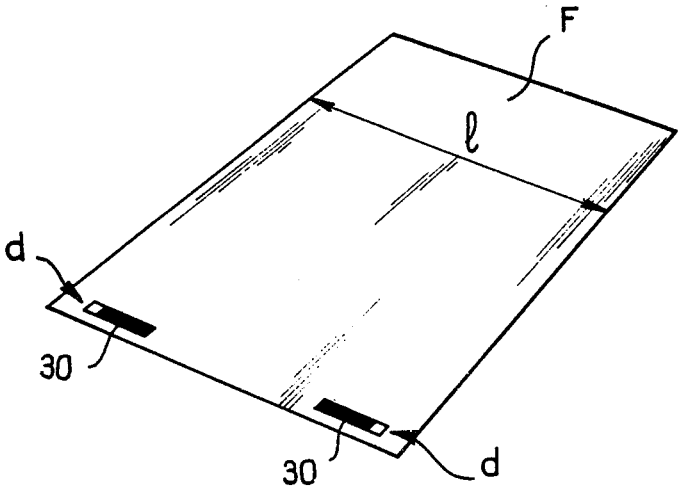
FIG. 4 is a perspective view showing how a sheet is retained by the rings with which the device is fitted.

As shown more particularly in FIG. 4, the curving is made possible by virtue of the fact that the portions 30 of the rings 3 are slightly narrower than the cut-outs (d) provided in the edges of the sheets for receiving the rings. The curving applied to the sheets ($F_2$) in this way improves their bending stiffness and prevents them from flopping out from the hooks 5, 50.

The user can write on the front face of the first sheet (F) of the block on the plate 1, with the face 10 then serving as a writing surface, in particular to write down appointments. The user can also write on the back of the same sheet by turning it through 180° round the rings 3 so as to bring the sheet to rest behind the device on the support surface (S), such as a table or a desk. Finally, the user can store and archive the sheet by passing it beneath the plate 1 and by moving it between the side lugs 5 and above the hooks 50. The sheets are thus archived without changing their order (e.g. chronological order), and it is easy to find a sheet which has been archived by extracting the sheets ($F_2$) from between the hooks 5, 50 and bringing them back on top of the plate 1.

It may be observed in this respect that the edges (b) (see FIG. 2) of the sheets ($F_2$) furthest from the rings 3 are easily accessible to the fingers of the user who can press against these edges after lifting the device just a little.

Figure 5:
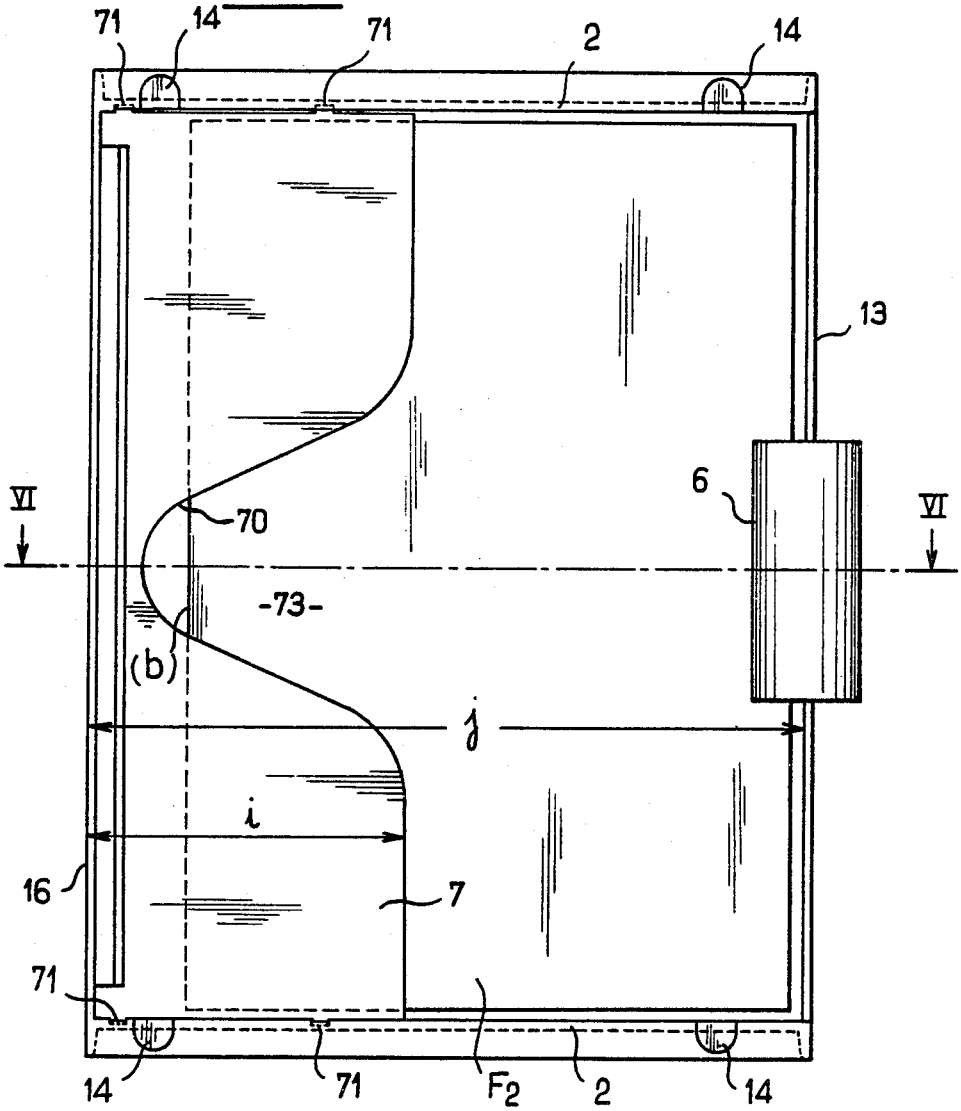
FIG. 5 is a bottom plan view of a second embodiment of the device.
Figure 6:
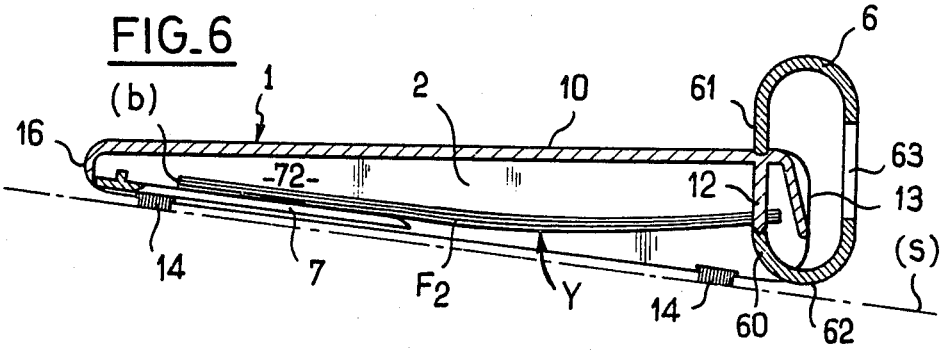
FIG. 6 is a side view of the FIG. 5 device in section on plane VI—VI of FIG. 5.
Figure 7:
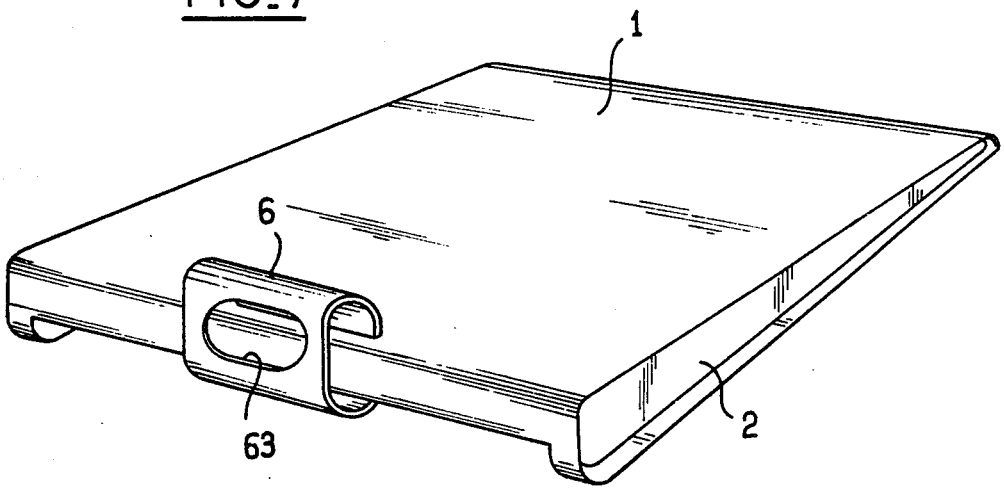
FIG. 7 is a perspective view of the device shown in FIGS. 5 and 6.

In the second embodiment of the device shown in FIGS. 5 to 7, the block of sheets ($F_2$) with which the device is provided is shown beneath the plate 1 constituting the writing surface, and items which are identical to or similar to items in the first embodiment are given the same references.

The plate 1 constituting the writing surface is at a slight slope, for example at an angle of 7° to 8° relative to the support surface (S), said disposition facilitating the positioning of the forearm while the user is writing on the plate.

The device is provided with a single retaining ring 6 which is placed in the middle of the edge 13 of the device, with said ring being fixed by resilient snap-fastening similar to the fastening of the rings 3 in the first embodiment. An opening 63 provided in the rear portion of the ring 6 serves to increase its resilience. This ring is intended to be passed through cut-outs of corresponding shape provided in the middle of the edge of each of the sheets ($F_2$) for the purpose of retaining and guiding them. The vertical projection 12 which constitutes an extension of the ring 6 is advantageously of sufficient vertical extent to ensure that the gap between the two ends of the ring is not less than the thickness of the block of sheets, thereby enabling said block to be inserted into the ring prior to the ring being fixed to the plate.

As in the above embodiment, the bottom portion 62 of the ring comes down close to the support surfaces (S), i.e, it is practically flush therewith.

Tabs 14 of flexible and preferably non-slip material are fixed, e.g., by gluing, at the four corners of the device at the bottoms of the side walls 2, and serve as feet by which it stands on the surface (S).

Beneath the plate 1 constituting the writing surface, and slightly above the level (S), there is a transverse shelf 7 whose depth (i) is much less than the length (j) of the device (see FIG. 5) such that the difference (j−i) makes it possible to position sheets ($F_2$) beneath the plate 1, said difference being large enough to allow the block of sheets ($F_2$) situated beneath the plate to begin sagging (Y) under the weight of the sheets ($F_2$), with the convex side of the sag (Y) being directed towards the support surface (S) on which the underframe 2 stands. This sag (Y) is necessary for the user to be able to extract the sheets ($F_2$) from the inside face of the shelf 7 when raising the device simply by applying finger pressure on the edge (b) of the sheets ($F_2$) situated furthest from the ring 3, with said sag (Y) enabling the sheets ($F_2$) to deform more fully in the sag direction (Y) under the action of said finger pressure. The shelf 7 thus overlaps only a portion of the space beneath the plate 1. It runs along the edge 16 which is furthest from the edge 13 that receives the ring 6. It is fixed to the device by side tabs 71 engaging in complementary notches provided in the sides 2. The shelf 7 has a central notch 73 which is generally V-shaped with the point of the V being directed towards the edge 16. The notch 17 thus flares towards the edge 13 which receives the ring 6. The edge 70 of said notch is rounded, rather than being angular. The point of the notch 73 is at a distance from the edge 13 having the ring 6 which is greater than the length of the sheets $F_2$, so that the edges b of the sheets are accessible in the notch 73.

The shelf 7 and the top plate 1 delimit a space or compartment 72 which is closed by the edge 16 and which is open along its edge facing the ring 6.

In order to store a sheet ($F_2$) beneath the plate 1, the sheet should be pivoted around the ring 6 through an angle of about 360°, and then slightly curved in order to bring it over the shelf 7 and inside the compartment 72. It is then automatically retained in this retracted position inside the device. In order to return the sheets retained beneath the plate 1 to the top thereof, it suffices to perform the opposite operation: access is easily obtained to the edges of the sheet because of the notch 73 in the middle of the retaining shelf 7.

Figure 8:
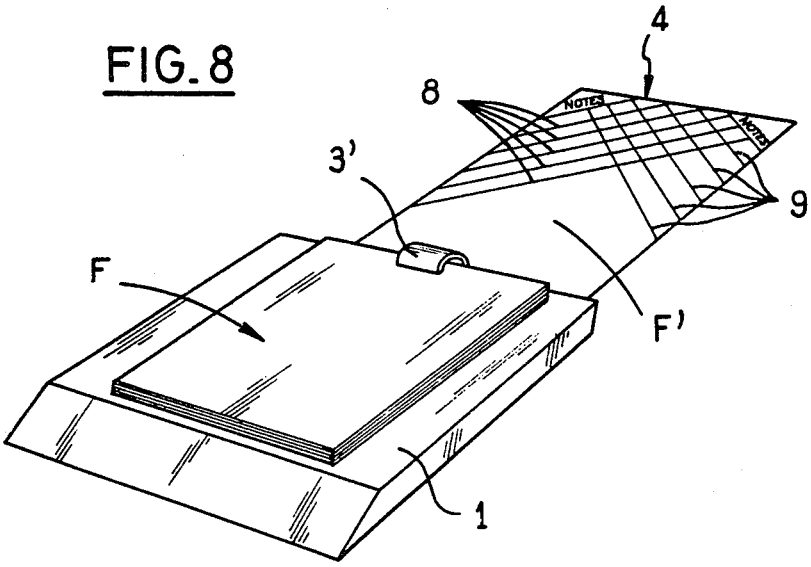
FIG. 8 is a perspective view of a variant of the FIG. 1 device.

The variant shown in FIG. 8 is similar to the first embodiment of the invention except that it is fitted, like the second embodiment, with a single central ring 3'. Further, the graphics space 4 provided on the rear of each sheet and which is visible when the sheet is extended over the support surface has mutually parallel lines printed thereon at an oblique angle relative to the edges of the sheets. In the example shown, two crossed networks of lines 8 and 9 are provided, with each network work being at an angle of 45°, for example, with the side edges of the sheets (F'). This sloping disposition of the lines facilitates writing on the sheet (F') since the arm can be moved round the writing surface in a natural manner. One of the networks (8) is intended for use by a right-handed user, whereas the other network (9) is intended for use by a left-handed user. The network 8, which will normally be used more frequently, may advantageously be marked heavier lines than the network 9.

The device in accordance with the invention may be used as a support for a diary in the form of a note block or as a support including sheets for reading or for writing.

I claim:

1. A device for supporting a block of sheets, the device comprising a plate having a top face which constitutes a writing surface, said writing surface being elevated above a support surface on which said device stands, an edge of said plate being provided with at least one ring which passes through cut-outs provided in edges of said sheets in order to retain said sheets on said plate, said ring interconnecting said top face with a bottom face of said plate, in such manner as to make it possible to move said sheets from a first position on said top face to a second position under the plate by rotating them through 360° around said ring, said device further comprising fastening and retention means stationary with respect to said plate for engaging said sheets and for supporting them beneath said plate at a predetermined distance above said support surface.

2. A device according to claim 1, wherein said ring has an elastically-deformable C-shaped section and is fixed to said edge of said plate by resilient snap-fastening.

3. A device according to claim 2, wherein said edge of the plate is provided with a projection constituting an extension of said ring and being of a size sufficient to occupy a gap between ends of said ring which gap is at least as wide as the thickness of said block of sheets.

4. A device according to claim 2, wherein said edge of said plate has an engagement chamfer for facilitating engagement of a ring thereon.

5. A device according to claim 1, wherein a bottom portion of said ring is substantially flush with said support surface.

6. A device according to claim 1, wherein said fastening and retention means are constituted by a pair of side lugs provided with hooks and disposed beneath said plate at a distance from each other which is slighty less than the width of said sheets.

7. A device according to claim 1, wherein said fastening and retention means are constituted by a shelf substantially parallel to said plate and disposed beneath said plate adjacent its edge opposite to said edge receiving said ring, the depth of said shelf being less than the length of said plate.

8. A device according to claim 7, wherein the difference between the length of said device and the depth of said shelf is large enough to allow a block of sheets situated beneath said plate to sag under the weight of said sheets.

9. A device according to claim 7, wherein a center portion of the shelf has a notch.

10. A device according to claim 1, wherein edges of the sheets opposite to the edges through which said ring passes are accessible to fingers of a user upon lifting of a front portion of said device when said sheets are retained beneath said plate.

11. A device according to claim 1, wherein a space for receiving notes is provided on a face of each sheet which is visible when said sheet is turned back onto said support surface.

12. A device according to claim 11, wherein said space includes at least one network of mutually parallel lines.

13. A device according to claim 12, wherein said lines are disposed obliquely relative to said edges of said sheets.

14. A device according to claim 13, wherein two crossed networks of oblique lines are provided on each sheet for use by right-handed and left-handed users, respectively.

* * * * *